United States Patent [19]

Stahl et al.

[11] 4,084,728

[45] Apr. 18, 1978

[54] CHILD-PROOF CLOSURE DEVICE FOR CONTAINERS

[75] Inventors: Otto Stahl, Finnentrop; Johannes Hins, Sundern, both of Germany

[73] Assignee: Georg Menshen & Co. KG., Finnentrop, Germany

[21] Appl. No.: 734,810

[22] Filed: Oct. 22, 1976

[30] Foreign Application Priority Data

Oct. 29, 1975 Germany ..... 7534301[U]

[51] Int. Cl.[2] ..... B67D 5/32

[52] U.S. Cl. ..... 222/153; 222/513

[58] Field of Search ..... 222/485, 548, 565, 512, 222/516, 518, 498, 509, 153, 513

[56] References Cited

U.S. PATENT DOCUMENTS 2,507,557 5/1950 Chester ..... 222/485 X

*Primary Examiner*—Stanley H. Tollberg

*Attorney, Agent, or Firm*—Fitzpatrick, Cella, Harper & Scinto

[57] ABSTRACT

A child-proof closure device for containers has an inner cap for securement on the container neck, and an outer cap rotatable on the inner cap between positions in which dispensing apertures in the caps are respectively aligned, to permit dispensing of the container contents, and covered, to prevent such dispensing. A square control projection on the inner cap is normally engaged with a star-shaped opening in the outer cap in one of positions angularly spaced by 45° to prevent rotation of the outer cap, and can be disengaged for rotation by axial inward pressure to resiliently deform the inner cap. A ring of projections on the outer cap can engage in corresponding depressions or in the dispensing apertures of the inner cap.

14 Claims, 4 Drawing Figures

CHILD-PROOF CLOSURE DEVICE FOR CONTAINERS

The invention relates to a child-proof closure device for containers, in particular for containers for pourable materials, having an inner cap securable to the neck of the containers and a locking cap arranged to be rotatable thereon, and wherein each cap is provided with at least one bore or aperture in such manner that the bore of the locking cap is rotatable so as to be brought into and out of alignment with the bore or aperture of the inner cap.

Such closure devices are frequently made use of for closing flasks or containers, intended to contain pourable discrete materials, such as powders, granular substances, pastilles and the like. The inner cap of such a closure device is securely connected to the mouth opening or the neck of the container or flask and is provided, preferably in its base wall, with a series of bores through the thickness of the material. The locking cap, which is fitted over the inner cap, is likewise provided with a series of bores, and is capable of being rotated in such a manner that the bores in the respective caps are either brought into the position of mutual alignment with each other or else are closed by the oppositely overlying wall regions of the respective caps. Experience has shown that such a type of simple manipulation for closing and opening the locking device is not adequate for guarding against the possibility that children can obtain access to the contents of the flasks or containers, which in some cases may be of noxious character. Although numerous attempts have been known to complicate the unscrewing of closure devices from the neck of a container with the object of making the manipulation child-proof, there still remains the need for a child-proof design of locking devices of the kind wherein the elements of the locking device are essentially incapable of being removed from the neck of the container.

It is accordingly an object of the present invention to provide a closure device for a container the manipulation of which is rendered child-proof by relatively simple means.

Briefly, in accordance with one aspect of the invention, the inner cap and the locking cap are constructed as complementary coupling elements determining the angular position of the locking cap relative to the inner cap and being disengageable by the application of external pressure.

The described coupling elements effectively prevent a relative rotation of the locking cap with respect to the inner cap, if, according to long accepted usage, an attempt is made simply to rotate the locking cap. Thus so long as the coupling elements are in engagement with each other, the bores in the locking cap and the inner cap remain in a relatively displaced position so that shaking out of the contents of the container is impossible.

Furthermore, the coupling elements of the invention are andvantageously so designed that an external pressure can be exerted upon one of these elements, for example by the index finger of the right hand, whereby the respective coupling element is brought out of engagement with the complementary element, and upon simultaneous rotation of the locking cap the latter may be brought into an angular position in which the respective bores coincide with each other. Because a certain amount of pressure is necessary in order to disengage the coupling elements from each other and, secondly, the manipulation requires a combined pressure and rotary movement, so that these operations can hardly be comprehended by a child, the closure device according to the invention offers the protection of a closure device with a child-proof manipulation. Moreover this result is achieved by the use of relatively simple means so that the closure device entails only a slight increase of cost as compared with the known closure devices.

Appropriately the coupling elements comprise a projection provided upon the resilient base wall of the inner cap and having a polygonal shape, which can be snapped into a polygonal hole of complementary shape formed in the base wall of the locking cap. In such a case the projection may have a square shape, and the hole in the locking cap may be formed of at least two component holes of square shape which are internested with each other, so that the angular position of the locking cap relatively to the inner cap can be fixed in at least two basic positions. Thus the projection may be disengaged from the hole by pressure upon the upper surface of the projection. In the first angular position of the locking cap the bore in the base wall of the inner cap is closed, and in the second angular position of the locking cap the bore in the base wall of the inner cap is aligned with that in the locking cap. Preferably however, a plurality of alternately positioned bores and impressions are provided in the base wall of the inner cap at equal intervals along a circular path, and in the base wall of the locking cap there are provided a plurality of alternately placed bores and projections at similar intervals along a circle concentric with that containing the bores and impressions. In such a construction the projections in the locking cap have the function of providing an additional sealing for the bores of the inner cap when the locking cap is situated in the first angular position. However, such a locking device is also suitable for such contained materials, whose grain size is such that it can be retained by simple covering of the respective bores by means of the overlying base wall of the locking cap. Moreover, this solution offers the advantage that when the containers are held in storage it is not necessary to provide an additional coverage for the inner cap, for example in the form of a film covering the base wall of the inner cap, which, when the container is brought into use, must be punctured or pulled off. Moreover, the projections seal the respective bores to such an extent that the ingress of moisture into the container is to a large extent avoided.

Whilst in the first angular position of the locking cap the projections upon said cap lock into and seal the bores of the inner cap, in the second angular position of the locking cap, in which the bores of the two caps are aligned with each other, the projections of the locking cap preferably engage in the depressions in the base wall of the inner cap, so that these projections do not then disturb the smooth contact between the overlapping opposite surfaces of the base walls of the inner cap and the locking cap. This feature also contributes to a functionally correct operation of the locking device because it prevents small quantities of the contents of the container from accumulating between the two surfaces.

The locking device according to the invention can be produced from any suitable material. Preferably, however, the locking cap and inner cap consist of a suitable synthetic plastics material, which can be formed in a particularly economic manner by the injection moulding process.

A practical example of the invention will now be described in more detail with reference to the accompanying drawing, in which.

The child-proof closure device illustrated in FIGS. 1 to 4 comprises basically two parts, which are the locking cap (compare FIGS. 1 and 2) indicated by the general reference 1, and the inner cap (compare FIGS. 3 and 4) indicated by the general reference 14. In use the locking cap 1 is retained by the inner cap 14, but in such a manner that the locking cap can be rotated relatively to the inner cap, and the inner cap is secured rigidly to the mouth opening of a flask or a container.

Figure 1:
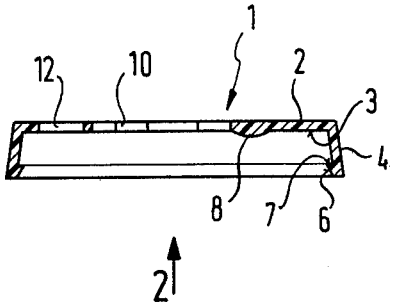
FIG. 1 is a section along the section line I—I of FIG. 2 through a locking cap for a child-proof closure device
Figure 2:
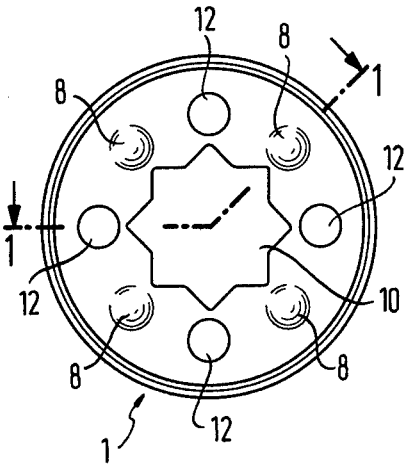
FIG. 2 is a plan view of the locking cap according to FIG. 1.

As shown in FIGS. 1 and 2 the locking cap 1 has a substantially frusto-conical cross section with a horizontal substantially plane base wall 2, at whose periphery there is formed a downwardly divergent annular flange 4. The depth of the locking cap 1 measured from its lower end surface to the upper surface of the base wall 2 is suited to the respective dimensions of the inner cap 14 according to FIGS. 3 and 4.

In the central region of the base wall 2 of the locking cap 1 there is provided a polygonal hole 10, whose plan shape in the present case is a combination of two component apertures, each of square shape mutually inclined at 45°. In this way there is formed a hole 10 having a star shaped configuration. In this way the hole 10 is so dimensioned to correspond to the shape of a projection 32 formed on the inner cap 14 (compare FIGS. 3 and 4) in such a manner that the projection can immovably lock into one of the square component holes. It is however obvious that, instead of using the configuration of the hole 10 shown in FIG. 2, any other shape of hole can be provided, subject to the condition that the locking engagement of the projection 32 with the hole can be ensured. In the present case the provision of the two component holes staggered with respect to each other by 45° affords the possibility that the locking cap can be locked by the projection 32 in two different angular positions.

A plurality of open bores 12 and projections 8 are arranged at equal intervals around a circle in the base wall 2 of the locking cap 1, the bores 12 and projections 8 following in alternate sequence as shown in FIG. 2. Preferably four such open bores 12 are provided at 90° intervals in the base wall 2, and a projection 8 is arranged symmetrically between each two adjacent open bores 12. The projections 8 have the form of a spherical cap and are integrally formed upon the lower surface 3 of the base wall 2 as shown in FIG. 1.

For the purpose of coupling together the locking cap 1 and inner cap 14 without obstructing the relative rotatability of the locking cap and the inner cap, a conical guide opening 6 is provided in the region of the lower end of the flange 4 of the locking cap 1 according to FIG. 1. This opening converges upwardly, that is to say from the outside of the cap to the inside and has a free diameter of the opening which is somewhat smaller than the maximum external diameter of the inner cap 14. The upper edge of the guide opening 6 is in the form of an annular substantially horizontal rebate surface 7 extending around the inner periphery of the flange 4 in the region of its lower end, and being capable of engaging underneath the lower side 26 of an annular flange 24 formed upon the inner cap 14 when the locking cap is forced over the inner cap.

Figure 3:
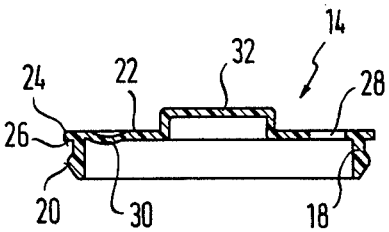
FIG. 3 is a section along the section line 3—3 according to FIG. 4 through an inner cap for the child-proof closure device.
Figure 4:
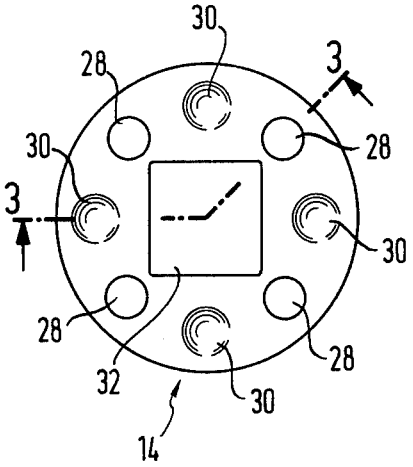
FIG. 4 is a plan view of the inner cap according to FIG. 3.

According to FIGS. 3 and 4, the inner cap 14 likewise is provided with a substantially horizontal base wall 22 and a peripheral annular flange 18, preferably depending vertically downwards. Furthermore the base wall 22 is outwardly extended beyond the annular flange 18 to form the horizontal annular flange 24. The central region of the base wall 22 is dished, as shown in FIG. 3, to form the boxlike extension 32 of square shape. The peripheral dimensions of the projection 32 are so chosen that this can slide into one of the square component holes which compose the hole 10 formed in the base wall 2 of the locking cap 1, so that the locking cap 1 can be fixed by the projection 32 in two different angular positions staggered by 45°. The description of the shape of the projection 32 applies in an analogous manner to the shape of the hole 10.

Similarly as in the case of the locking cap 1, the base wall 22 of the inner cap 14 is provided with a series of, preferably trough shaped, depressions 30 and open bores 28, these being arranged upon a circle of the same radius as that upon which lie the projections 8 and open bores 12 of the locking cap 1. As shown, four open bores 28 and four trough shaped depressions 30 are provided, these being arranged in alternate sequence and at constant spacing from each other. The shape of the depressions 30 corresponds to that of the projections 8 provided upon the lower surface of the base wall 2 of the locking cap 1, so that these depressions can receive and lock the projections 8 in a predetermined angular position of the locking cap. This is the case if the locking cap 1 has been rotated through 45° from the position of FIG. 2 into the position of the inner cap 14 shown in FIG. 4. However, the projections 8 can easily slide out of the depressions 30 upon performing a further rotation or reverse rotation of the locking cap 1. In this connection it may be further pointed out that the projections 8 on the base wall 2 of the locking cap 1 are also shaped to correspond to the diameter of the bores 28 in the base wall 22 of the inner cap 14 so that when the locking cap 1 and the inner cap 14 are in the relative angular positions shown in FIGS. 2 and 4, the projections 8 extend into and seal the open bores 28 in the inner cap, whilst in this angular position the depressions 30 of the inner cap are in alignment with the bores 12 of the locking cap. In consequence of this arrangement, when the elements are in the first mentioned angular position the open bores 12 and 28 coincide with each other so that the material can be poured out of the container, whilst in the last mentioned angular position the open bores 28 are tightly closed. In this arrangement the angular positions are determined by the respective positions of engagement of the projection 32 with one of the component holes, which together constitute the hole 10 in the base wall 2 of the locking cap 1.

As shown in FIG. 3, there is formed in the region of the lower end of the flange 18 of the inner cap 14 an outer shoulder 20, so that upon inserting the flange 18 into the mouth opening of the container said shoulder can be brought into engagement with a correspondingly shaped annular peripheral groove formed in said mouth opening whereby the flange 18 is securely retained in the mouth opening of the container. Instead of such an arrangement, it is also possible to provide the flange 18 with a thread, whereby the inner cap 14 can be screwed into a corresponding thread in the neck opening of the container.

The mode of functioning of the above described child-proof closure device is as follows. If, as previously mentioned, the inner cap 14 has its flange 18 connected in a suitable manner with the mouth of the container, not shown in the drawing, the locking cap 1 is forced over the inner cap 14 until the rebate surface 7 of the locking cap snaps underneath the lower side 26 of the annular flange 24 of the inner cap 14. With the locking cap 1 so arranged, the projection 32 of the inner cap 14 extends through the polygonal hole 10 of the locking cap shown in FIG. 2, so that the latter is locked against any rotation relative to the inner cap. Furthermore the two caps assume a relative position to each other as shown in FIGS. 2 and 4 so that the open bores 28 are closed by the projections 8 and so that the open bores 12 lie opposite to the depressions 30. In order to permit the contents of the container to be discharged, it is necessary for the open bores 12 of the locking cap 1 and the open bores 28 of the inner cap 14 to be brought into alignment by relative rotation. This is effected by exerting such an axial pressure upon the upper surface of the projection 32 projecting through the hole 10 that the base wall 22 of the inner cap 14 yields resiliently downwards, and thereby brings the said surface of the projection 32 into a position spaced from the hole 10 in the locking cap 1. Whilst maintaining this position of the projection 32, the locking cap 1, preferably provided with an externally knurled surface, is rotated for such time until the projection 32 is aligned with the 45° displaced component aperture of the hole 10 in the locking cap 1. If now the projection 32 is released in this position it will snap into the respective component aperture and thus fix the described angular position of the locking cap 1. In this angular position the open bores 12 in the locking cap 1 are in alignment opposite to the open bores 28 of the inner cap 14, whilst the projections 8 upon the locking cap lock into the depressions 30 of the inner cap. For closing the closure device the described manipulation is performed in the reverse manner.

The above described factual example of the inventive closure device can be modified in various ways. Thus the closure device is not restricted to the form represented and to the number of projections 8 and depressions 30 in the locking cap 1 and the inner cap 2, nor is the invention restricted to the number of open holes 12 and 28. Although the provision of the projections 8 upon the locking cap and the depressions 30 upon the inner cap afford the advantage that the open bores 28 are tightly sealed at the inner cap, it is basically possible to dispense with these elements. In such a case the open bores 28 in the inner cap would simply be covered by the area of the base wall 2 of the locking cap extending between two adjacent open bores 12 of said cap. Furthermore the invention is not restricted to the represented form of the projection 32 and of the hole 10. The decisive feature is solely that both elements shall be so matched in shape that at least the closed position of the closure cap is locked in the described manner and that the dimensions of the locking cap 1 and the inner cap 14 are designed to enable them to perform the described function. Finally it may be pointed out that the parts 1 and 14 comprising the closure device may be produced from any suitable material, but preferably of synthetic plastics material. In the latter case the injection moulding process particularly suggests itself as the production method.

The present invention has been described in detail with reference to a specific illustrative embodiment, but it will be apparent to those skilled in the art that various modifications may be made without departing from the spirit or scope of the invention.

We claim:

1. A child proof closure device for a container, the closure device comprising an inner cap member adapted to be secured to the container neck and having at least one dispensing aperture therein, an outer cap member having at least one dispensing aperture therein, means permitting relative rotation of said inner and outer cap members between first and second angular positions, said apertures in said first angular position co-operating to permit dispensing of container contents therethrough, and said aperatures in said second angular position being angularly spaced to prevent such dispensing of container contents, and latching formations on said inner and outer cap members, said latching formations being adapted, when in latching condition, to co-operate to prevent relative rotation of said inner and outer cap members into said first angular positions without the application of external pressure to deform said inner cap member to place said latching formations in unlatching condition.

2. The closure device of claim 1 wherein said complementary latching formations comprise a non-circular outwardly extending projection on said inner member, and a non-circular opening in said outer cap member, said projection extending through said aperture and engaging the side edge thereof in said first and second angular positions of said inner and outer cap members to prevent relative rotation thereof and being displaceable from said aperture by deformation of said inner cap member in response to said external pressure.

3. The closure device of claim 2 wherein said projection and said opening are of polygonal cross-section.

4. The closure device of claim 2 wherein said projection is of square-cross section and said opening can accommodate said projection in a plurality of positions angularly spaced by 45°.

5. The closure device of claim 2 wherein said projection can be disengaged from said opening by application of pressure to the surface of said projection exposed through said opening.

6. The closure device of claim 1 wherein each of said inner and outer cap members has a plurality of said dispensing apertures equiangularly spaced by an angular distance greater than the angular extent of each aperture about a circle centered on the axis of relative rotation of said inner and outer cap members.

7. The closure device of claim 6 wherein the surface of one of said inner and outer cap members lying adjacent the other of said cap members has a plurality of projections equiangularly spaced around said circle, for reception in the dispensing apertures of the other of said cap members in the second angular position of said cap members.

8. The closure device of claim 7 wherein the other of said inner and outer cap members has a plurality of depressions equiangularly spaced around said circle in the surface thereof adjacent the other of said cap members, said depressions being located between the dispensing apertures and adapted to receive said projections therein.

9. The closure device of claim 1 wherein both said inner and outer cap members are injection moulded from synthetic plastics material.

10. The closure device of claim 1 wherein said means permitting relative rotation of said inner and locking cap means comprises inter-engaging peripheral formations on said inner and locking cap means.

11. A child proof closure device for a container comprising inner and locking cap means each having at least one dispensing aperture therein, said inner cap means being adapted to be secured to the neck of the container, said locking cap means having means guiding said cap means for relative rotation between a dispensing position in which said dispensing apertures are aligned and a closed position in which the dispensing aperture in at least one of said cap means is blocked by said other cap means, and latch means on said inner and locking cap means, said latch means being adapted to be in rotation preventing engagement in said dispensing and in said closed positions of said cap means and to be separable to permit rotation between said positions by deformation of at least one of said cap means.

12. The closure device of claim 11 wherein at least one of said inner and locking cap means has at least one projection adapted to be received in said at least one dispensing aperture of the other of said inner and locking cap means in the closed position thereof.

13. The closure device of claim 11 having an opening in said locking cap means, said opening exposing a portion of said inner cap means to which axial inward pressure can be applied to effect said deformation thereof.

14. The closure device of claim 13 wherein said exposed portion comprises an outwardly extending projection said opening and said projection, being shaped to constitute said latch means.

* * * * *